United States Patent [19]

Moldenhauer

[11] 4,356,367

[45] Oct. 26, 1982

[54] ELECTRIC SWITCH

[75] Inventor: David W. Moldenhauer, LaGrange, N.C.

[73] Assignee: Joy Manufacturing Company, Pittsburgh, Pa.

[21] Appl. No.: 46,975

[22] Filed: Jun. 8, 1979

[51] Int. Cl.[3] ..... H01H 9/02

[52] U.S. Cl. ..... 200/298; 200/157; 200/243

[58] Field of Search ..... 200/298, 159 B, 244, 200/157, 243, 5 A, 5 B, 5 E, 6 R, 6 A, 72 R, 75, 238, 239, 295, 280, 160

[56] References Cited

U.S. PATENT DOCUMENTS

| | | | |
|---|---|---|---|
| 2,891,132 | 6/1959 | Devonshire et al. | 200/298 |
| 2,931,877 | 4/1960 | Henley | 200/280 |
| 3,086,090 | 4/1963 | Carroll | 200/298 |
| 3,369,097 | 2/1968 | Murakami | 200/280 |
| 3,378,664 | 4/1968 | Russenberger | 200/160 |
| 3,648,000 | 3/1972 | Thompson | 200/72 R |

*Primary Examiner*—Willis Little

[57] ABSTRACT

An electric switching apparatus having a nonconducting outer housing member containing a nonconducting inner member having a cavity therein containing a plurality of electrical contacts and a conducting rod. The contacts are resiliently supported and the conducting rod is resiliently supported between corresponding sets of resiliently deformable diaphragms. A conducting stiffening member is resiliently supported between the inner and outer nonconducting members.

43 Claims, 10 Drawing Figures

ELECTRIC SWITCH

This invention relates to an electrical switching device and more specifically switches of the type having nonconductive outer housings, resiliently supported contacts, and having momentary contact. In the past it has been difficult to provide a low cost reliable pendent type switch which was effectively insulated and sealed against intrusion of dust, water and oil. Such pendent type switches are used in many industrial applications such as for example to provide raise and lower electrical switching functions to a hoist or crane mechanism. Pendent type switches are normally suspended from an overhead structure by the electrical cable which may include an integral support rope or cable. It is highly desirable that the switch have an outer insulating cover. Because such a pendent switch is suspended and at times held in the operator's hand, certain size weight and impact resistant requirements compatible with such service must be obtained. Prior attempts to provide a rugged reliable pendent switch meeting these requirements have resulted in expensive complex mechanisms.

I provide the switching apparatus in which the contacts and a conductor bar are operably supported by integral portions of the housing members. The housing members provide for maintaining the switch in an off position, compensating for contact wear, and effective environmental sealing.

In momentary switches the electrical conductive path between two circuits usually require the forcible movement of a movable contact into physical contact with a stationary contact. A spring or other tensioning means is usually required to return the movable contact to its normal or off position after the switching force is removed. I provide for integral portions of the insulating housing members to rotatably support the movable contact, effect the return of the movable contact, and seal the contact portion of the switch from the external environment.

Accordingly, one object of this invention is to provide a novel switch housing which is inexpensive to manufacture, electrically insulated from the internal electrical conducting portions, and effectively sealed against intrusion of dust, water and oil.

Another object of this invention is to provide a highly reliable switching apparatus which is free of complex component parts and includes only a minimum number of interchangable component parts.

Another object of this invention is to provide an electrical switch which is easy to install, repair, and replace.

Another object of this invention is to provide a reliable switching mechanism which provides for a positive off position even following an operation which causes the movable contact to be partially welded to one or both of the stationary contacts by permitting at least one of the welded contacts to be freed.

Another object is to provide a switch housing which will effectively seal the internal switch mechanism from water, dust and oil even when various size electrical cables are attached to the switch.

Another object of this invention is to provide a switching apparatus in which some contacts are repositionable so as to provide additional electrical contact surface as the contact member wears. My invention further provides for rotatably mounting the movable contact so as to distribute the contact wear over a large surface area.

Another object of this invention is to provide a switching mechanism allowing over travel of the movable contact and allowing some under travel of the movable contact caused by the operators involuntary finger movement.

Other objects and features of the invention will become apparent to those skilled in the art as the disclosure is made in the following detailed description of present preferred embodiments.

DESCRIPTION OF PRESENT PREFERRED EMBODIMENTS

Figure 1:
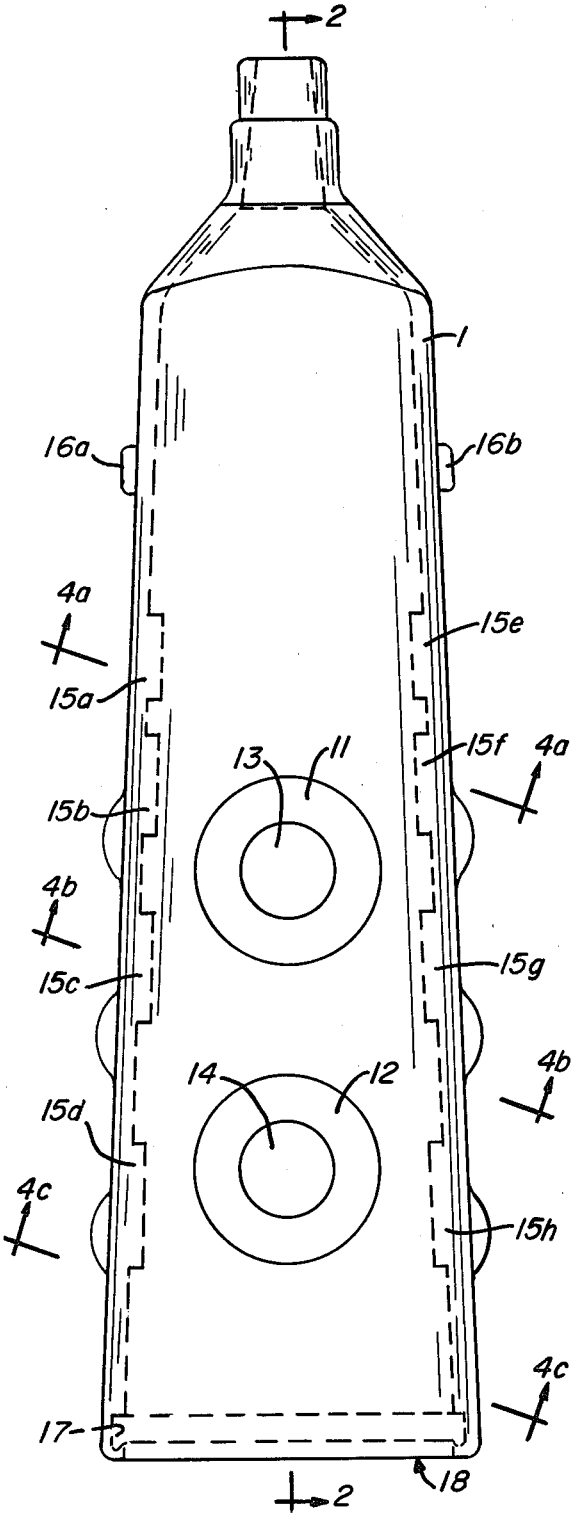
FIG. 1 is a front view of the pendent switch with the interior outline of the outer housing member shown in dashed line.

FIG. 1 is a front view of a pendent switch showing the outer insulating housing member 1 with the interior surface of the outer housing member indicated in dash line. The outer housing 1 is made of an electrically insulating and resilient material, such as for example neoprene, rubber, plastic, or other elastomeric material. In normal operation outer housing 1 is suspended from an overhead structure either by a cable which enters the cable entrance 10 or by a separate susepension cable which can be attached to the outer housing 1 by means of an inverted U-shaped hanger bracket which attaches to 16*a* and 16*b* respectively by known fastening means such as for example a metal rod extending through the switch housing members on by a screw on each side of the U-shaped bracket engaging the stiffener member 2. The elongated cable entrance 10 projecting from the uppermost portion of the outer housing 1 permits access for the electrical cable which feeds electrical signals to the switch and provides support for the pendent switch. In referring to FIGS. 1 and 2 it can be seen that the cable entrance 10 has exterior surfaces having discrete incrementally stepped diameters while the interior surface of the cable entrance 10 is generally conically shaped with the taper diverging inwardly. Such configuration allows the pendent switch to be used with a number of different size electrical cables. As the outer housing 1 and the cable entrance 10 are made of a resilient material a pressure or interference fit between the cable and the housing can be made between the adjacent portions. During installation the cable entrance 10 may be cut back or severed perpendicular to the axis of the tapered bore to a stepped diameter such that the diameter of the tapered surface forcibly accepts the sized cable being used and maintains a resilient seal against the intrusion of water and dust between the cable and the outer housing 1. Such clamping means provides a pressure fit between the outer surface of the electrical cable and the inner tapered surface of the cable entrance 10.

The outer housing 1 has two resilient diaphragms 11 and 12 and corresponding push buttons 13 and 14 associated with such diaphragms. In one application of the pendent switch, such as for example when the switch is used to direct the operation of an overhead hoist push button 13 would be used to initiate a raising of the hoist and push button 14 would be used to initiate the lowering of the hoist. In such an application the pendent switch functions as a single pole double throw momentary switch, with an off or a non-conducting position leaving all circuits in an open state when neither button is depressed.

Figure 2:
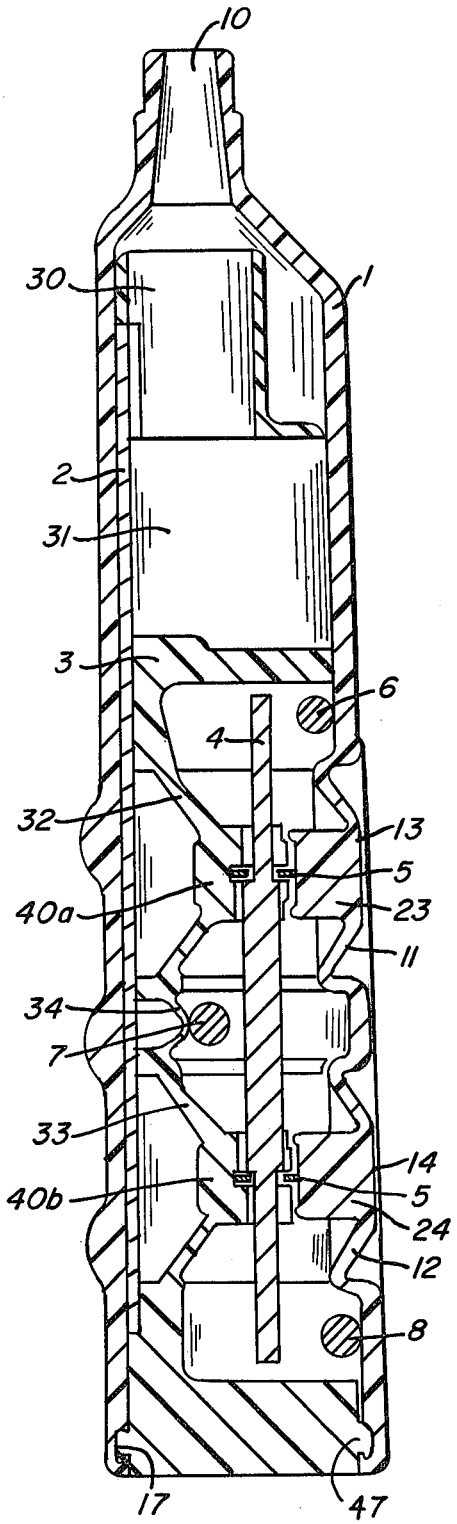
FIG. 2 is a cross-sectional view of the right side of the switch taken along line 2—2 in FIG. 1.

The interior sides of the outer housing 1 contains integral knobs 15*a* through 15*h* which project inward and are used to engage corresponding apertures on the internal members of the switch such as for example in the embodiment shown in FIG. 2 the stiffening member 2. When for example the knobs 15 are of circular cross section as in the present preferred embodiment the diameter of such cross section may vary from knob to knob so as to provide a unique interlock between the stiffening member 2 and the outer housing 1. The maximum dimension of the knobs engagingly interlock with corresponding dimensions on the apertures on the stiffening member 2. In the embodiments of FIG. 1 the projections are of circular cross-section and the outer circumferential surface is the engaging interlocking surface. In some embodiments the height or projection extent is the interlocking variable. As can be seen in FIG. 1 of the present preferred embodiment an opening 18 bottom of the outer housing 1 provides for insertion and withdrawal of the internal parts 2 through 9, and for access to the terminal ends of wires coming into the switch through cable entrance 10. Knobs 15*a* and 15*e* are of smaller diameter than knobs 15*b* and 15*f* which respectively are of smaller diameter than knobs 15*c* and 15*g* which respectively are smaller than the diameter of knobs 15*d* and 15*h*. Decreasing in the diameter of the knobs 15 as the distance of such knobs from the opening 18 increases allows corresponding apertures in the stiffening member 2 to engage only those knobs having a corresponding diameter. This allows for easy insertion and withdrawal of the stiffening member 2 into the outer housing member 1 by means of the bottom opening 18; because small diameter apertures in the stiffening member 2 will override the larger diameter knobs in the outer during the insertion process until all such knobs and apertures are in alignment with corresponding knobs. Such alignment and resulting engagement between knob 15*a* and aperture 61 can be seen in FIG. 4*a*.

As can be seen in FIG. 1 an annular sealing channel 17 extends circumferentially around the lower inner surface of the outer housing 1. This channel 17 and the corresponding annular rib or ring 47 extends continuously around the corresponding adjacent surfaces of the outer housing 1 and the inner member 3. Referring to FIG. 2 shows the cable entrance 10 of the outer housing 1 which, as previously had been explained, is sealed upon the insertion of the wiring cable. The lower opening in the outer housing 1 is sealed by engagement of an annular ring 47 of the inner housing 3 with the outer housing sealing channel 17. As both housing members 1 and 3 are made of a resilient material, the ring 47 adjacent channel 17 is made slightly larger than the dimension of the channel 17 such that when the switch is assembled the channel 17 is forceably engaging the ring 47 on the adjacent portion of inner housing member 3. Such resilient forceable engagement results in an effective water, dust, and oil seal on the lower portion of the housing members 1 and 3. As has been shown when an electric cable of proper size is fitted within the cable entrance 10 and the inner member 3 is inserted within the opening 18 the internal mechanism of the switch is effectively sealed from contaminates.

As can be seen in FIG. 1 and in referring to FIGS. 4 the switch and more particular the outer housing has diverging sides to provide a tapered exterior and interior to said outer housing member 1. This taper provides for ease of insertion of the stiffening member 2, the inner member 3, and engagement of the projection 15 with apertures on the stiffening member 2.

Referring to FIG. 2 shows a cross section of the pendent switch assembled and unwired to an external circuit. The stiffening member 2 is made of a rigid material, such as for example steel, and is held intermediate between the inner and outer housings 1 and 3. The stiffening member 2 preferably extends around the inner surface of outer housing 1 on the three inside surfaces of the outer housing 1 without obscuring the operation of the diaphragms 11 and 12. It is desirable to attach the stiffening member 2 to the inner housing member 3 prior to insertion of the stiffening and inner members into opening 18. The stiffening member 2 may be attached to the inner housing member by, for example, an adhesive coating, a friction fit between the inner member 3 and the stiffening member 2 or by projections of the stiffening member 2 being received in corresponding pockets in the inner member 3.

The stiffening member 2 is preferably made of steel or other rigid electrically conductive material, and of generally channel shape with apertures in the channel sides corresponding to the knobs 15*a* through *h*. The back side of the channel 2 maybe solid as shown in FIG. 2 or have perforations such that the volumes behind diaphragms 32, 33 and 34 may be in vented communication. The operation of diaphragms 11, 12, 32, 33 and 34 results in a displacement of the air on one side of the diaphragm in the present preferred embodiment all diaphragms are interconnected and in fluid communication with each other by passageways. The displaced air behind the diaphragm may then flow into the other diaphragm spaces and into the cavities and channels of the switch, so that the switching pressure on button 13 and 14 do not depend upon such fluid flow rate.

It will be apparent to those skilled in the art that the electrical cable enters the outer housing through the cable entrance 10, then enters the inner housing member 3 by means of the cable opening 30. A cable chamber 31 is provided for termination of the cable shielding and necessary space is provided for separation of the individual conductors within the cable bundle. Cable chamber 31 may include provision for securing a support wire or rope within the electric cable bundle to either the stiffening member 2 or the nonconducting parts of the switch. Such connection means would include, for example, a machine screw attached to a ground wire within the electrical cable bundle threaded into the stiffening member 2. In addition a wiring tie or worm driven hose clamp may be used to clamp the cable within opening 30 to the inner member 3 and the stiffener 2. The electric wires for carrying switch signals are then directed through specific wiring channels within the inner housing member 3 to specific electric contacts. In the present preferred embodiment wiring channels 35 and 36 are used to provide passageway for three electric wires which are connected to contact members 6, 7 and 8 respectively. Channels 35 and 36 are shown in FIGS. 3, 4*a*, 4*b* and 4*c*. As shown in FIG. 2 the present preferred embodiment when used in a hoist circuit is to connect contact member 7 to a common electric wire, contact 6 to a "lower" signal wire, contact 8 to a "raise" signal wire the wiring of the switch to other external circuits will be apparent to those knowledgeable in the art. As shown in FIG. 2 the switch is in its normal non-conducting state or off position without any electrical connection between contacts 6, 7, or 8. A conducting rod 4 is resiliently supported in a position of nonconduction with contacts 6, 7 and 8. The buttons 13 and 14 are integral parts of the outer insulating housing member 1 and are attached thereto by means of integral deformable resilient diaphragm portions 11 and 12 respectively of the outer housing 1. On the interior side of the outer housing 1 immediately adjacent buttons 13 and 14 are integral support projection portions 23 and 24. The inner member 3 has integral resilient diaphragms 32 and 33 connected to integral support portions 40*a* and 40*b* respectively. Diaphragms 11, 12, 32 and 33, as shown in FIG. 2, are in a nondeformed state or condition, and provide resilient support to flat washers 5 which in turn rotatably support connecting rod 4. Diaphragms 11 and 32 act to support and center washer 5 between the contacts 6 and 7 associated with the upper end of rod 4. Diaphragms 12 and 33 likewise support washer 5 at the lowermost end of rod 4. As shown in FIG. 2 the connecting rod 4 has end portions of smaller diameter than the center portion such that a shoulder is formed between the center section and each end portion. The washers 5 respectively ride on these shoulders to rotatably retain the rod 4 in spaced relationship between diaphragm pair 32, 11, and pair 33, 12. The center contact 7 is supported by resiliently deformable diaphragm 34, which allows for a limited rearward movement of the contact 7 by deformation of the diaphragm 34.

The buttons 13, 14 and respective diaphragms 11, 12 are recessed from the front surface of the switch housing 1 as shown along the right side of the view in FIG. 2. Such recessing of the buttons tends to prevent undesired operation of the switch by accidental pressure on the switch such as occurs for example when the switch is dropped or struck sharply.

Figure 3:
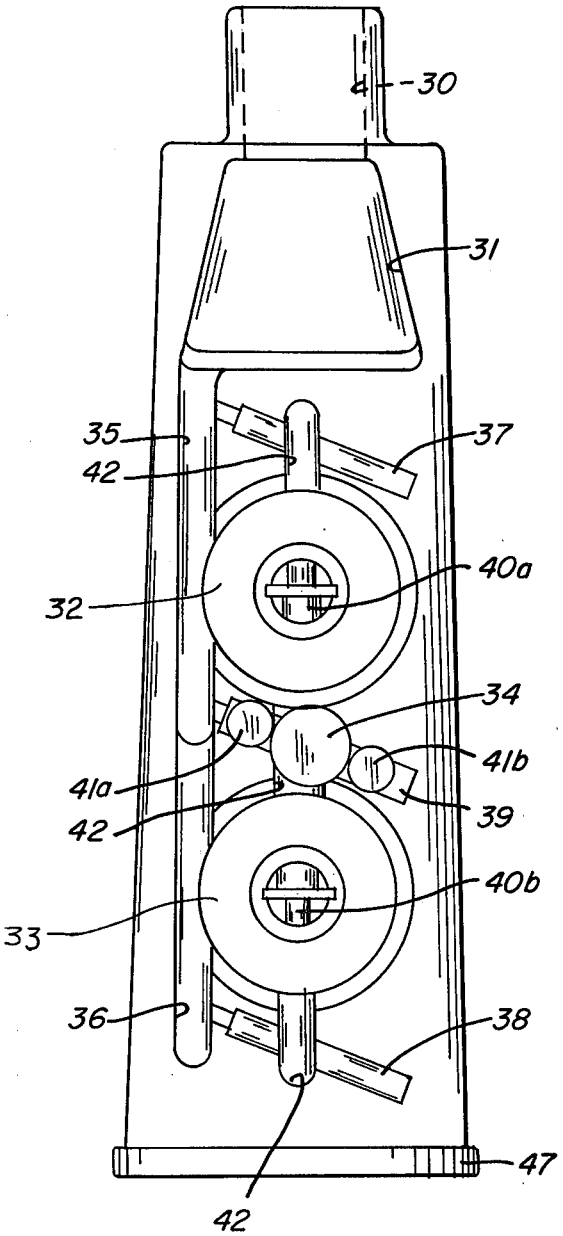
FIG. 3 is a front view of the inner housing member showing the central cavity portion with all component parts removed.

FIG. 3 shows a front view of the inner member 3 with the cable opening 30 leading into the cable chamber 31. Contact 6 is supported in an upper contact channel 37, and the wire connecting to the upper contact 6 is routed from chamber 31 by means of wiring channel 35. The lower contact 8 is supported in the lower contact channel 38, and the wire to connect contact 8 is routed from the cable chamber 31 by means of wiring channel 35 and the wiring channel extension 36. The middle contact member 7 is supported within a middle contact channel 39 by means of two contact support posts 9 which respectively fit within post holes 41*a* and 41*b* in the inner insulating member 3. The top portion of the middle diaphragm 34 appears in FIG. 3 in a position so as to support contact 7 when it is placed within the channel 39. Extending down the center of the inner housing member 3 is a longitudinal channel 42 which allows for rotation and pivoting of the conducting rod 4. FIG. 3 shows diaphragms 32 and 33 which are integral parts of the inner housing and have integral portions 40*a* and 40*b* which provide rear support to the conducting rod 4.

As is apparent in FIG. 3 the channels 35, 36, 37, 38, 39, 42, holes 41*a*, 41*b*, and diaphragms 32, 33, 34 form a central cavity in the inner housing member 3 in which the switching components are mounted.

As shown in FIG. 3 is an annular ring 47 on the lowermost portion of the inner housing member 3 so as to effectively seal the outer housing 1 in the area of the annular sealing channel 17.

Figure 4A:
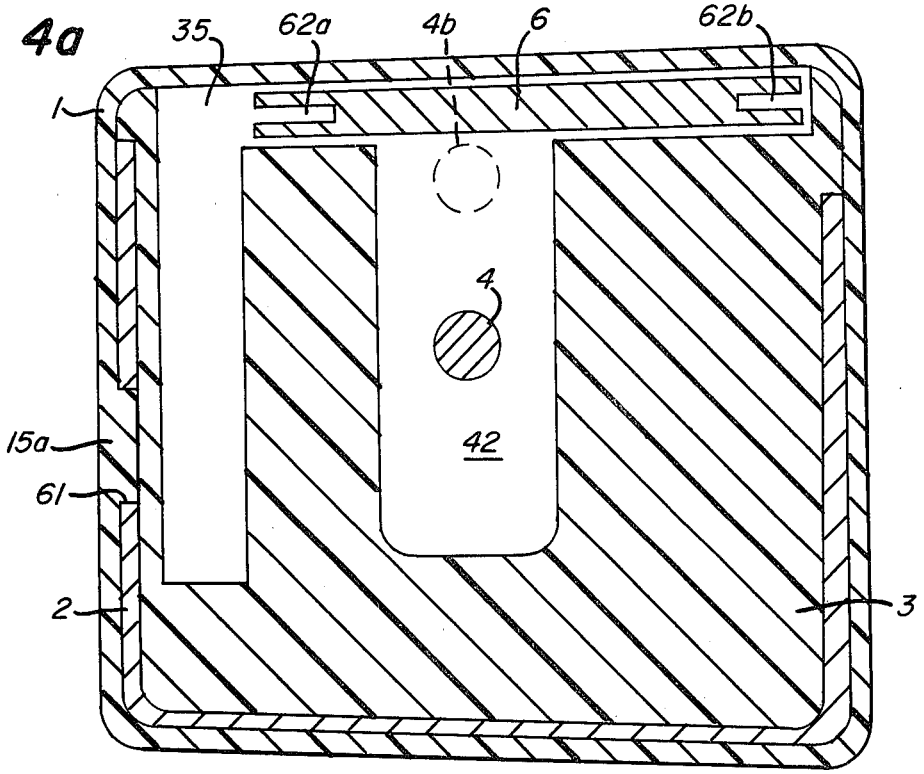
FIG. 4*a* is a cross sectional view of the switch taken along line 4*a*—4*a* in FIG. 1 and shows the upper contact portion.

FIG. 4*a* shows a cross section of the switch taken along line 4*a*—4*a* of FIG. 1 and shows the upper portion of the switch in the vicinity of contact 6. The outer housing member 1 circumferentially encloses the switch as shown in this cross section. Knob 15*a* can be seen to interlock with the aperture hole 61 in the stiffening member 2. It is to be understood that similar apertures exist in the stiffening member 2 to interlock with knobs 15*b* through 15*h* as shown in FIG. 1, and such apertures vary in diameter so as to correspond with respective adjacent knobs. Wiring channel 35 which extends along one side of the switch provides a route for the wires to all of the contacts. As shown in FIG. 4*a* wiring channel 35 provides access for a wire to one end of contact 6. The rod 4 is generally centered within the rod channel 42 and is in spaced relationship from any surface on the contact 6. The stiffening member 2 surrounds the inner member 3 on three sides and is electrically insulated from contact 6 and conducting rod 4 shown at 4*b* is an interim position of the end of the conducting rod 4 prior to the conducting rod 4 making electrical contact with the contact member 6. During normal switch operation when button 14 is depressed and diaphragm 12 deformed the end of conducting rod 4 closest to contact 6 rises to the position of 4*b*, as shown in FIG. 4*a*, and continues upward until physical and electrical contact is established with contact members 6. As can be seen in FIG. 4*a* the contact 6 is positioned such that the rod 4 contacts the contact member 6 off center, that is as shown in FIG. 4*a* to the left of the midpoints between the wire bores 62*a* and *b*. During use contact wear is initially restricted to the portion of contact 6 directly above position 4*b*. After a normal amount of wear occurs in that section of the contact 6, the contact 6 may be flipped end for end so as to reverse the positions of slots 62*a* and 62*b*. This procedure allows for additional contact wear on member 6 on the end associated with slot 62*b*. The electrical signal wire is brought to contact 6 by means of channel 35, and secured to contact 6 by insertion of the wire to either bore 62*a* or 62*b* whichever of the respective bores is in position adjacent to channel 35. The signal wire may be secured in the bore 62*a* or alternatively 62*b* by known methods, such as for example crimping of the contact 6, soldering, or by means of a set screw. Contact 6 is preferably of circular transverse cross section. Contact 6 is resiliently supported and insulated from the other portions of the switch by the inner housing member 3 and the outer housing member 1. By constructing contact 6 with a circular cross section and resiliently mounting contact 6 in channel 37, allows limited rotation and movement of contact 6 to maximize the contact wear surface available and cushions the impact during switching operations. By positioning contact 6 so that electrical contact between rod 4 and contact 6 occurs other than at the longitudinal midpoint, allows contact 6 to be flipped end for end and produces a contact component which is easily renewed for double the normal life expectancy.

As described herein the contacts 6, 7, 8 and rod 4 have a circular cross-section, but other shapes are included within the invention, such as for example square, rectangular, oval, and triangular shaped cross-sections. While described herein the electric contact between conducting members of the switch is described as a surface area, such contact includes the limited surface or point contact occurring typically between two curvilinear surfaces such as the cylindrical shaped rod 4 and cylindrical shaped contacts 6, 7 and 8.

Figure 4B:
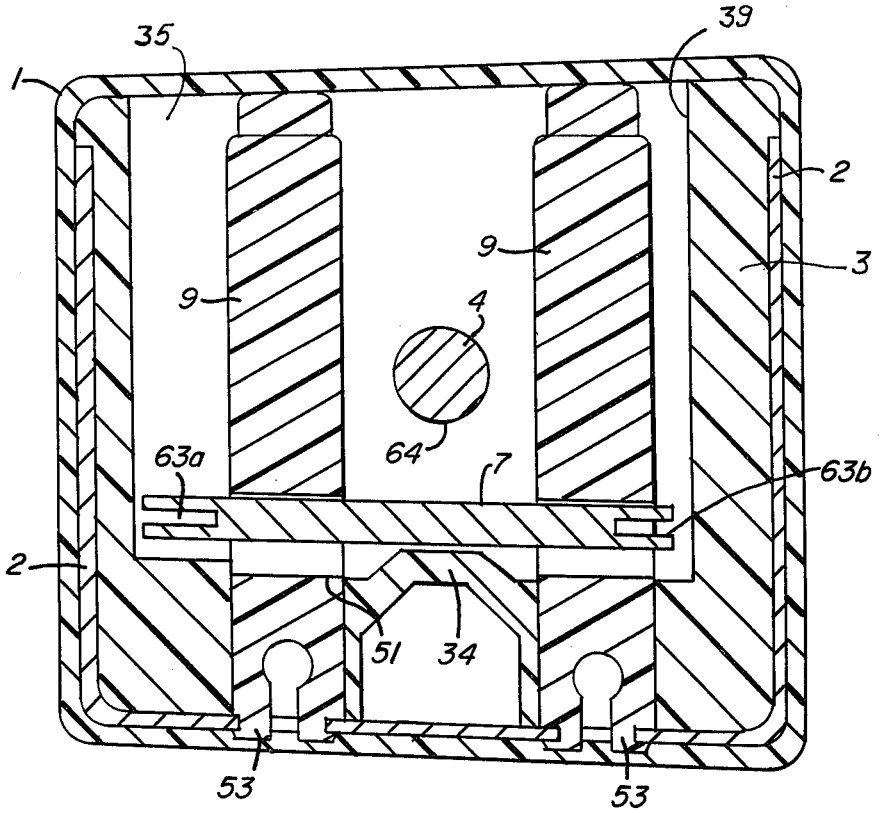
FIG. 4*b* is a cross sectional view of the switch taken along line 4*b*—4*b* in FIG. 1 and shows the center contact portion.
Figure 4C:
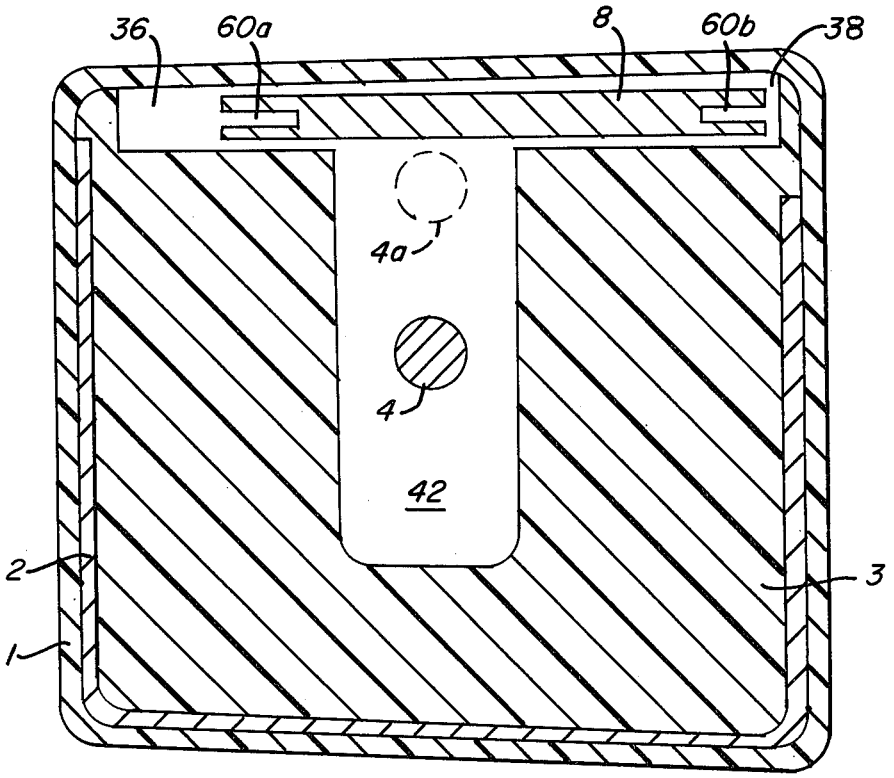
FIG. 4*c* is a cross sectional view of the switch taken along line 4*c*—4*c* in FIG. 1 and shows the lower contact portion.

Referring to FIG. 4*c* shows a cross section of the pendent switch taken along line 4*c*—4*c* in FIG. 1. The lower end of the conducting rod 4 is shown centered in the rod channel 42 in the inner housing 3. The stiffening member 2 is interposed between the outer housing 1 and the inner member 3 so as to provide stiffened wall portions on three sides of the switch, and leaves open the front portion of the inner housing 3. In FIG. 4*c* is shown an interim position 4*a* of the end portion of the connecting rod 4 as it rises to contact contact member 8 as would occur when only button 13 is depressed. The signal wire is routed to contact 8 by means of wiring channel 36. Contact 8 is positioned in such a manner within channel 38 that normal contact wear occurs at either of two alternative portions on the contact which are positionable above the area of 4*a*. Wire bores 60*a* and 60*b* are provided so that the signal wire may be alternatively attached to either end of the contact 8. The contact 8 may be positioned within contact channel 38 such that either bore 60*a* or 60*b* is adjacent channel 36 and available for connection to the signal wire. The contact 8 is similarly constructed having circular cross-section and positioned off center with respect to rod 4 so as to provide maximum contact life as hereinbefore described with regard to the upper contact member 6.

Referring now to FIG. 4*b* which is a cross section along 4*b*—4*b* of FIG. 1 shows the outer housing member 1 and the inner housing member 3 with the stiffening member 2 intermediate thereto and partially surrounding the inner housing 3. Positioned within the midle contact channel 39 are two contact support posts 9 and the middle contact member 7. The signal wire is brought to contact 7 from chamber 31 by means of wiring channel 35, and the signal wire is then electrically connected to contact 7 by either alternatively bore 63*a* or 63*b*. Contact 7 is similarly positioned off center as has been described with respect to contacts 6 and 8 such that contact 7 may be flipped end for end, thereby exchanging bore 63*a* with 63*b* so as to provide an unused portion of contact 7 to be positioned directly beneath the conducting rod 4. The contacting point 64 on the outer surface of the conducting rod 4 will then be brought into electrical contact at a different area on contact 7 during switch operations.

Figure 5:
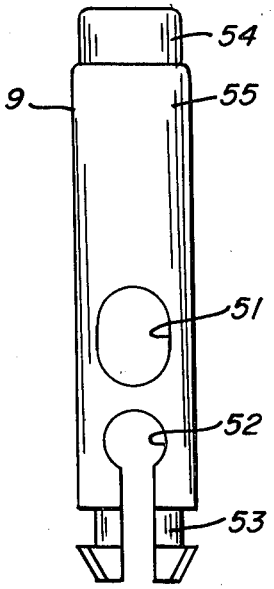
FIG. 5 is a side view of the center contact post.

As has previously been described contact 4 is rotatably mounted within diaphragms 11, 32, 12, 33, and therefore different sections of the outer circumferential surface of conducting rod 4 as shown in FIG. 4*b* at 64 will be brought to bear upon contact 7 during switch operations. As shown in FIG. 4*b* contact 7 is restrained within the limits of the middle contact slot 51 and the upper diaphragm 34. Referring to FIG. 5 shows a middle contact support post 9 having an upper portion 54 which may act to secure such post 9 in the resilient inner or outer housings 3 and 1. The middle portion 55 of the post 9 is secured within respective post holes 41*a* or 41*b* as shown in FIG. 3. A bore 52 in post 9 and a bifurcated hook portion 53 provide for fixably engaging the stiffening member 2. FIG. 4*b* shows the hook portions 53 engaging such stiffening member 2. Post members 9 are preferably made of a nonconducting material, such as for example nylon. As shown in FIG. 5 the contact slot 51 is elongated to provide limited movement of the contact 7 in a plane perpendicular to the axis of rod 4. As shown in FIG. 4*b* the resilient diaphragm 34 urges the contact 7 to its uppermost position within slot 51. In operation as buttons 13 or 14 are depressed the portion of the contacting rod 4 as shown in FIG. 4*b* is caused to descend into electrical contact with the contact 7; and additional force on either of buttons 13 or 14 causes overtravel of the connecting rod 4 and which subsequently depresses resilient diaphragm 34 while maintaining electrical contact between the conducting rod and contact 7. As the rod 4 descends it tends to pivot about the axis of contact 7.

Figure 6A:
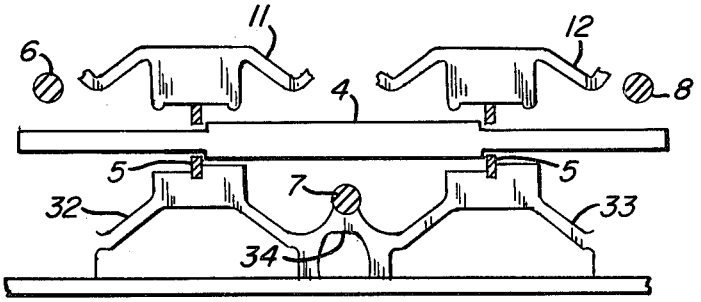
FIG. 6*a–c* show a diagrammatic representation of the switch operations as would generally be seen along line 2—2 of FIG. 1.
Figure 6B:
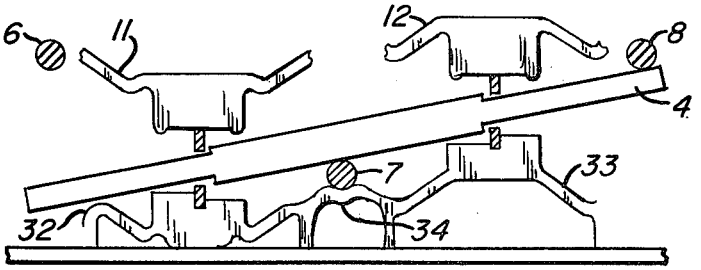
Figure 6C:
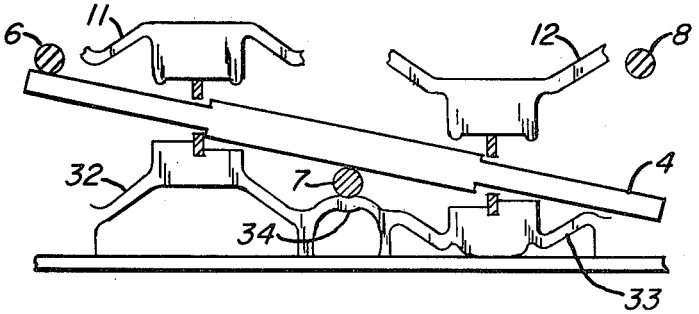

Referring now to FIGS. 6*a* through 6*c* wherein is shown a diagrammatical representation of switch operations as would generally be seen along the cross section line 2—2 of FIG. 1. In all three figures the conducting bar 4 is rotatably supported within washers 5; and washers 5 are supported intermediate the diaphragm pair 11 and 32, and diaphragm pair 12 and 33. Contacts 6 and 8 are resiliently supported within channels 37 and 38 respectively of the inner housing 3. Contacts 6 and 8 are resiliently supported but are permitted only relatively limited movement as supplied by the resilient material surrounding such contacts. Contact 7 is resiliently supported by diaphragm 34. In FIG. 6*a* the switch is shown in the off position with contacts 6, 7 and 8 electrically isolated and in a nonconducting relationship with the conducting rod 4. In FIG. 6*a* all four diaphragms 11, 12, 32, and 33 are in a relaxed, non-deformed state. FIG. 6*a* represents the switch function of a single pole double throw switch in a neutral or "off" position.

FIG. 6*b* shows the pendent switch in a position which brings contact members 7 and 8 into electrical contact. This is the state which occurs when only button 13 is depressed to deform diaphragm 11 downward and exert pressure on washer 5 which in like manner lowers and the conducting rod 4 pivots in a counterclockwise direction about contact 7. Whereby electrical contact is established between rod 4, contact 7 and contact 8. In FIG. 6*b* the downward force on the washer 5 held intermediate diaphragms 11 and 32 causes diaphragm 32 to collapse downward. In this state diaphragms 12 and 33 remain in a relatively nondeformed condition. It is to be noted that some minor deformation may occur in diaphragms 12 and 33 to allow alignment of the conducting bar 4 between contact 7 and contact 8. As shown in FIG. 6*b* diaphragm 34 is deformed downward under the pressure of the conducting bar 4 bearing against contact 7; such resilient deformation of diaphragm 34 insures forcible contact between contact 7 and the conducting rod 4, allows for limited over travel in the depression of button 13 and associated diaphragm 11, and allows for wear on contacts and support members. When button 13 is released the resilient actions of diaphragms 11 and 13 reposition the conducting rod to the position as shown in FIG. 6*a* and thereby terminate the conductive path between contacts 7 and 8.

The deformation of diaphragm 34 also allows for minor finger movement of the operator, which in a fixed movement switch would result in an interrupted circuit. The slot 51 in post 9 limit the over travel permitted by the diaphragm 34. Additional over travel may be gained by material choice and dimension in the integral resilient contact channels 37, 38, 39 of the inner housing member 3, which also permit limited over travel.

FIG. 6*c* shows a switch in a position in which contact member 6 and contact member 7 are in electrical contact. This state occurs when only button 14 is depressed deforming diaphragm 12 which in turn through forcible contact with washer 5 causes diaphragm 33 to be deformed downwardly, and the conducting rod 4 tends to pivot clockwise about contact 7. Contact 7 is forcibly brought to bear against conducting rod 4 such that diaphragm 34 is caused to deform downward slightly thereby insuring uniform pressure on the conducting rod 4 by the contact member 7. In the switch state shown in FIG. 6*c* diaphragms 11 and 32 are generally in a nondeformed state, but may be slightly deformed to allow alignment between the conducting rod 4 and contact member 6 and 7. Upon release of button 14, diaphragm 12 and 33 resiliently reposition rod 4 to the position shown in FIG. 6*a*, thereby interrupting the electrical path between contacts 7 and 8.

As has been described hereinabove when either button 13 or 14 is depressed the rod 4 moves until the rod touches contact 7, and then pivots about contact 7 until either contact 6 or 8 respectively is forcibly engaged by rod 4. It is to be understood that in some embodiments the rod 4 may engage either contact 6 or 8 first and then pivot about that contact until the rod touches contact 7. Other embodiments strive to have simultaneous physical contact between contact member 7 and either contact member 6 or 8. The distance between respective contacts and the geometry between the rod and the contacts along with the relative stiffness of the respective diaphragms determine the sequence of contact engagement during the switching operation.

As is apparent from FIGS. 6*a*, 6*b* and 6*c* the diaphragm pair 11 and 32 operate independently from the diaphragm 12 and 33. One of the advantages of such independent operation of these paired diaphragms, is that when both buttons 13 and 14 are depressed this causes all four diaphragms to deform downward such that the conducting rod 4 only contacts contact member 7, and therefore no conductive path is established between any pair of contact member 6, 7 and 8. A further advantage of this independent operation of paired diaphragms is apparent as in the case when the contacting rod is caused to weld to one of the contact members 6 or 8, whereby the conductive path is maintained even after the respective button has been released. This undesirable conductive path may be terminated by the simultaneous forcible depression of both buttons 13 and 14 which causes both ends of the conductive rod 4 to be forcibly removed downward from contact members 6 and 8. Depression of both buttons 13 and 14 causes all four diaphragms 11, 12 and 32 and 33 to deform downward such that the conducting rod is held in a position parallel to that position shown in FIG. 6*a* but at a level such that conducting rod 4 is spaced from contact elements 6 and 8.

As is apparent from the preceding consideration of FIGS. 6*a*, 6*b* and 6*c* the rod 4 pivots about the contact 7, and as such the outer circumferential surface of contact 7 provides a fulcrum for the pivoting of rod 4.

As shown in FIG. 6 the conducting rod 4 is loosely held within the center bore in washer 5 such that conducting rod 4 is freely rotatable within such washers. During normal operation of the switch which has outer housing member 1 and in housing member 3 composed of a resilient material such as for example rubber or plastic, some contact between the conducting rod 4 and the insulated surfaces of the rod channel 42 occur. As rod channel 42 in inner member 3 is a nonconducting material, such contact between the conducting rod 4 and the rod channel 42 or other insulated portion of the switch produces no harmful effects upon the switching characteristics of the device. Instead such physical contact provides an unbalanced frictional force on the outer surface conducting rod 4. Such frictional force upon conducting rod 4 causes rod 4 to partially rotate within support washers 5 during the depression or release of buttons 13 or 14. This rotation of conducting rod 4 results in a generally even distribution of wear along the outer circumferential surface of rod 4 in the areas where rod 4 contacts the contact members 6, 7 and 8. In this manner the rotation and resultant even distribution of wear on conducting rod 4 results in increased life to the conducting rod. Additional rotational forces on rod 4 result from frictional contact with 40*a*, 40*b*, 23, 24, and the actual contact members 6, 7 and 8.

As used herein words such as above, below, back, front, side, inward, outward, and words of similar import in the absence of an express indication to the contrary at a specific location are provided as a general indication and are not limiting.

Having described herein certain presently preferred embodiments of this invention it is to be distinctly understood that other variations, modifications and embodiments may be made without departing from the broad spirit and scope of the invention. It is to be understood that the invention is not limited to the present preferred embodiments described herein but may be otherwise variously embodied as provided within the scope of the appended claims.

I claim:

1. An electric switch apparatus comprising:

an inner member composed of a resilient electrically non-conducting material;

a plurality of electrical contacts at least partially disposed within said inner member;

conducting means at least partially disposed within said inner member for selectively forming a conductive electrical path between preselected pairs of said contacts;

said inner member having at least one integral resiliently deformable diaphragm means for at least partially supporting said conducting means;

an outer resilient housing member at least partially surrounding said inner member;

said outer member having cable entrance means for providing for access by a plurality of electrical conductors to said contacts; and said outer member having at least one integral resilient deformable diaphragm means adapted to be operably engaging said conducting means for at least partially supporting said conducting means and transmitting forces applied to the exterior of said housing member to said conducting means to form an electrical path between preselected pairs of said contacts.

2. The electric switch apparatus of claim 1 further comprising:

resilient sealing means for sealing said contacts and said conducting means from the environment external to said housing.

3. The electric switch apparatus of claim 2 wherein said sealing means includes:

said outer member having an opening for permitting the insertion and withdrawal of said inner member; and said inner member is resiliently fitted within said opening.

4. The electric switch apparatus of claim 3 further including:

said outer member having an inwardly open channel in the inner surface of said outer member adjacent said opening;

and said inner member having an outward projecting rib portion engaging said channel.

5. The electric switch apparatus of claim 3 wherein said channel and said rib portion are substantially continuous.

6. The electric switch apparatus of claim 1 wherein: said diaphragm means of said outer member has an integral button portion for transferring forces to deform said diaphragm means.

7. The electric switch apparatus of claim 1 wherein said diaphragm means of said outer member is recessed from the outermost surface of the adjacent portions of said outer housing member.

8. The electric switch apparatus of claim 1 wherein said diaphragm means of said outer member is recessed from the outermost surface of the adjacent portion of said outer housing member;

said diaphragm means of said outer member has an integral button portion for transmitting forces to deform said diaphragm means of said outer member; and said diaphragm means of said outer member includes an integral inwardly directed support projection for at least partially supporting said conducting means.

9. An electric switching apparatus comprising:

an inner member composed of an electrically non-conducting resilient material;

switch means having a plurality of electric contacts at least partially disposed within said inner member and said switching means having conducting means for selectively establishing conductive paths between such contacts;

a stiffening member at least partially surrounding said inner member;

an outer electrically non-conducting resilient housing member at least partially enclosing said switching means and said stiffening member; and said outer housing member having at least one integral deformable diaphragm operably associated with said conducting means to maintain said switch means in a preselected position when said diaphragm is in a substantially non-deformed condition.

10. The electric switch apparatus of claim 9 wherein said stiffening member is composed of an electrically conducting material.

11. The electric switch apparatus of claim 9 wherein said outer housing member is generally elongated having cable entrance means at one end;

said outer member having an opening for inserting and withdrawing said inner member at the end opposite said entrance means; and said outer member having tapered sides generally extending longitudinally and divergingly from said entrance means to said opening.

12. The electric switch apparatus of claim 9 further comprising:

said outer housing having a plurality of inwardly directed spaced resilient projections; and said stiffening member having a plurality of apertures in corresponding spaced relationship engaging said projection, whereby relative separating movement between said housing and said stiffening member is reduced.

13. The electric switch apparatus of claim 12 wherein said outer member is generally elongated having cable entrance means at one end;

said outer housing member having an opening for insertion and withdrawal of said stiffening and said inner member at the end opposite said entrance means; said outer member having tapered sides extending generally longitudinally and divergingly from said entrance means; and said resilient projections extending inwardly along opposing inner surfaces of said sides.

14. The electric switch apparatus of claim 13 wherein said pluralities are four or more and said projections are disposed in longitudinal spaced relationship in equal numbers along two opposing inner surfaces of said sides.

15. The electric switch apparatus of claim 14 wherein said projections are arranged from said opening in order of decreasing maximum dimension of said projection; and said apertures are arranged in corresponding order of respective dimension.

16. The electric switch apparatus of claim 12 wherein:

said outer member includes an opening through which said stiffening member and said inner member are insertable; and said projections are disposed in longitudinal spaced relationship inward from said opening.

17. The electric switch apparatus of claim 16 wherein said projections are arranged from said opening in order of decreasing maximum dimension; and said apertures are arranged in corresponding order of respective dimension.

18. An electric circuit switching apparatus comprising:

a housing;

an electrically conducting rod having an end portion and a middle portion and an end opposite portion;

mounting means for supporting said rod in said housing;

a first electric contact means in said housing for providing an electrical connection to a circuit external to said housing;

said first contact having a first electrically conducting surface in spaced relationship from said rod and generally adjacent said end portion of said rod;

a second electric contact means in said housing for providing an electrical connection to a circuit external to said housing;

said second contact means having a second electrically conducting surface in spaced relationship from said rod said second surface generally adjacent such middle portion of said rod said second contact surface positioned on the side of said rod generally opposite said first contact surface;

a third electric contact means in said housing for providing an electrical connection to a circuit external to said housing;

said third contact means having a third electrically conducting surface in spaced relation from said rod said third surface generally adjacent said end opposite portion of said rod said third surface positioned on the side of said rod opposite said secondd surface;

said mounting means permitting externally applied forces to selectively reposition said rod to contact alternatively either said first and second surfaces or said third and second surfaces; and said mounting means positioning said rod in a spaced relationship to said second surface such that absent such externally applied forces said second surface is not in electrical contact with said rod.

19. An electric circuit switching apparatus comprising:

a housing;

an electrically conducting rod having an end portion and a middle portion and an end opposite portion;

mounting means for supporting said rod in said housing;

a first electric contact means in said housing for providing an electrical connection to a circuit external to said housing;

said first contact having a first electrically conducting surface in spaced relationship from said rod and generally adjacent said end portion of said rod;

a second electric contact means in said housing for providing an electrical connection to a circuit external to said housing;

said second contact means having a second electrically conducting surface in spaced relationship from said rod said second surface generally adjacent such middle portion of said rod said second contact surface positioned on the side of said rod generally opposite said first contact surface;

a third electric contact means in said housing for providing an electrical connection to a circuit external to said housing;

said third contact means having a third electrically conducting surface in spaced relation from said rod said third surface generally adjacent said end opposite portion of said rod said third surface positioned on the side of said rod opposite said second surface;

said mounting means permitting externally applied forces to selectively reposition said rod to contact alternatively either said first and second surfaces or said third and second surfaces; and second contact support means for resiliently supporting said second contact and permitting said second contact to be forcibly displaced by said rod.

20. The electric circuit switching apparatus of claim 19 wherein said second contact means includes a generally cylindrical contact composed of an electrically conducting material and having said second surface around at least a portion of the outer peripheral surface of said cylindrical contact; and said second support means includes at least two contact support posts mounted in relative spaced relationship within said housing, said posts having slots operably supporting respective portions of said cylindrical contact to permit said contact limited movement in a direction away from said rod.

21. The electric circuit switching apparatus of claim 20 wherein said second contact support means includes a resilient diaphragm forcibly urging said cylindrical contact in the direction of said rod.

22. The electric circuit switching apparatus of claim 21 wherein said resilient diaphragm is an integral portion of said housing.

23. The electric circuit switching apparatus of claim 20 wherein said support posts are composed of an electrically non-conducting material.

24. The electric circuit switching apparatus of claim 18 wherein at least one of said first, second and third contact means includes:

a cylindrical contact of electrical-conducting material having a center and end portions; and said housing includes contact support means for positioning said at least one contact in either of two positions whereby different axial sections of said center portion of said contact are positioned adjacent said rod.

25. An electric circuit switching apparatus comprising:

a housing;

an electrically conducting rod having an end portion and a middle portion and an end opposite portion;

mounting means for supporting said rod in said housing;

a first electric contact means in said housing for providing an electrical connection to a circuit external to said housing;

said first contact having a first electrically conducting surface in spaced relationship from said rod and generally adjacent said end portion of said rod;

a second electric contact means in said housing for providing an electrical connection to a circuit external to said housing;

said second contact means having a second electrically conducting surface in spaced relationship from said rod said second surface generally adjacent such middle portion of said rod said second contact surface positioned on the side of said rod generally opposite said first contact surface;

a third electric contact means in said housing for providing an electrical connection to a circuit external to said housing; said third contact means having a third electrically conducting surface in spaced relation from said rod said third surface generally adjacent said end opposite portion of said rod said third surface positioned on the side of said rod opposite said second surface;

said mounting means permitting externally applied forces to selectively reposition said rod to contact alternatively either said first and second surfaces or said third and second surfaces;

at least one of said first, second and third contact means includes a cylindrical contact of electrical-conducting material having a center and end portions;

said housing includes contact support means for positioning said at least one contact in either of two positions whereby different axial sections of said center portion of said contact are positioned adjacent said rod; and said contact having wire attaching means on each end portion of said cylindrical contact.

26. The electric circuit switching apparatus of claim 25 wherein said attaching means includes generally axially directed bores in each of said end portion for insertion of an electrically conductive wire.

27. The electric switching apparatus of claim 24 wherein said first, second and third contact means each include identical cylindrical contacts of an electrically conducting material each having a center portion and end portion; and said housing includes contact support means for positioning each of said contacts in either of two positions whereby different axial sections of said center sections are positioned adjacent said rod.

28. An electric circuit switching apparatus comprising:

a housing;

an electrically conducting rod having an end portion and a middle portion and an end opposite portion;

mounting means for supporting said rod in said housing;

a first electric contact means in said housing for providing an electrical connection to a circuit external to said housing;

said first contact having a first electrically conducting surface in spaced relationship from said rod and generally adjacent said end portion of said rod;

a second electric contact means in said housing for providing an electrical connection to a circuit external to said housing;

said second contact means having a second electrically conducting surface in spaced relationship from said rod said second surface generally adjacent such middle portion of said rod said second contact surface positioned on the side of said rod generally opposite said first contact surface;

a third electric contact means in said housing for providing an electrical connection to a circuit external to said housing; said third contact means having a third electrically conducting surface in spaced relation from said rod said third surface generally adjacent said end opposite portion of said rod said third surface positioned on the side of said rod opposite said second surface;

said mounting means permitting externally applied forces to selectively reposition said rod to contact alternatively either said first and second surfaces or said third and second surfaces;

said mounting means including a first pair of resiliently deformable diaphragm means arranged generally diametrically opposite and generally adjacent said end portion of said rod and supporting said rod in spaced relation between said first contact surface and said second contact surface when said first pair of diaphragm means are in a nondeformed state; and said mounting means including a second pair of resiliently deformable diaphragm means arranged generally diametrically opposite and generally adjacent said end opposite of said rod and supporting said rod in spaced relation between said second contact surface and said third contact surface when said second pair of diaphragm means are in non-deformed state.

29. The electric circuit switching apparatus of claim 28 wherein said mounting means includes rotatably holding means for permitting free axial rotation of said rod between said diaphragm means such that external forces are transmitted from said diaphragm means through said holding means to said rod.

30. The electric circuit switching apparatus of claim 29 wherein said holding means includes flat washer means axially mounted on said rod and having an opening diameter greater than the adjacent portion of said rod.

31. The electric circuit switching apparatus of claim 29 wherein said end portion and said end opposite portion of said rod have respective diameters differing from the diameter of said center portion of said rod whereby shoulders are formed between said adjacent portions of said rod.

32. The electric circuit switch apparatus of claim 31 wherein said holding means includes flat washer means axially mounted on said rod adjacent said shoulders; and said washer means having an opening diameter greater than the diameter of said rod radially inward of said opening; and said diameter of said opening being less than the diameter of said shoulder to thereby resist substantial axial movement of said rod.

33. An electric circuit switching apparatus comprising:

a housing;

an electrically conducting rod having an end portion and a middle portion and an end opposite portion;

mounting means for supporting said rod in said housing;

a first electric contact means in said housing for providing an electrical connection to a circuit external to said housing;

said first contact having a first electrically conducting surface in spaced relationship from said rod and generally adjacent said end portion of said rod;

a second electric contact means in said housing for providing an electrical connection to a circuit external to said housing;

said second contact means having a second electrically conducting surface in spaced relationship from said rod said second surface generally adjacent such middle portion of said rod said second contact surface positioned on the side of said rod generally opposite said first contact surface;

a third electric contact means in said housing for providing an electrical connection to a circuit external to said housing; said third contact means having a third electrically conducting surface in spaced relation from said rod said third surface generally adjacent said end opposite portion of said rod said third surface positioned on the side of said rod opposite said second surface;

said mounting means permitting externally applied forces to selectively reposition said rod to contact alternatively either said first and second surfaces or said third and second surfaces; and said first contact and said third contact are resiliently supported.

34. An electric circuit switching apparatus comprising:

a housing;

an electrically conducting rod having an end portion and a middle portion and an end opposite portion;

mounting means for supporting said rod in said housing;

a first electric contact means in said housing for providing an electrical connection to a circuit external to said housing;

said first contact having a first electrically conducting surface in spaced relationship from said rod and generally adjacent said end portion of said rod;

a second electric contact means in said housing for providing an electrical connection to a circuit external to said housing;

said second contact means having a second electrically conducting surface in spaced relationship from said rod said second surface generally adjacent such middle portion of said rod said second contact surface positioned on the side of said rod generally opposite said first contact surface;

a third electric contact means in said housing for providing an electrical connection to a circuit external to said housing;

said third contact means having a third electrically conducting surface in spaced relation from said rod said third surface generally adjacent said end opposite portion of said rod said third surface positioned on the side of said rod opposite said second surface;

said mounting means permitting externally applied forces to selectively reposition said rod to contact alternatively either said first and second surfaces or said third and second surfaces;

said housing includes inner and outer members composed of a resilient material; and said first contact means and said second contact means are resiliently supported in channels in said inner member.

35. An electric contact for a switching circuit comprising:

an elongated rod composed of an electrical conducting material having a center portion and end portion;

wire attaching means on each of said end portion;

an electrical contact surface extending at least partially around the circumference of said center portion; said attaching means including an axial bore in said end portion for insertion of an electric wire; and the diameter of said bore being such that said end portion may be crimped into electrically contacting such wire.

36. An electric switching apparatus comprising:

a first electric conductor having a first electrically conductive surface generally lying in a first plane;

at least one second electric conductor having a second electrically conductive surface generally lying in a second plane, such second plane generally parallel to such first plane;

an elongated rod composed of electrically conductive material; and mounting means for alternatively positioning said rod in either a plane between and generally parallel to such first and second planes, or in planes that intersect such first and second planes such that the outer surface of said rod adjacent the midpoint of said rod electrically contacts said first conductive surface and said rod electrically contact one of said second conductive surfaces.

37. The electric switching apparatus of claim 36 having two second conductors relatively spaced from each other each having a second conductive surface generally equidistance from said midpoint of said rod; and said first surface is generally equidistant from said two second surfaces.

38. The electric switching apparatus of claim 36 wherein said first surface having fulcrum means for pivoting said midpoint of said rod about said first surface.

39. The electric switching apparatus of claim 36 wherein each of said first surface said second surface and said outer surface have at least one point generally lying in a common plane generally perpendicular to such first and second planes.

40. A method of switching in electric circuits comprising:

supporting an elongated rod composed of an electrically conducting material the axis of such rod generally lying in a plane;

positioning at least one first electric contact above such rod and in spaced relationship from such plane;

positioning a second electric contact below such rod and in spaced relationship from such plane and adjacent the center section of such rod on the side of such rod opposite such first contact;

connecting such first and second contacts to electric circuits; and creating an electrical connection between a preselected one of such first contact and such second contact by sequentially moving such rod in a direction away from such plane until such center section of such rod physically contacts such second contact then while maintaining forcible contact with such second contact pivoting such rod around such second contact until such rod forcibly contacts such one contact.

41. The method of switching in electric circuits of claim 40 wherein said positioning at least one first electric contact includes:

positioning two electric contacts generally equidistant from the midpoint of such rod.

42. The method of switching in electric circuits of claim 40 further comprising:

moving such second contact in such direction away from such plane during such pivoting of such rod.

43. The method of switching in electric circuits of claim 40 further comprising:

moving such second contact in such direction away from such plane after such rod forcibly contact such one contact.

* * * * *